US010919606B2

(12) United States Patent
Rau Andersen et al.

(10) Patent No.: US 10,919,606 B2
(45) Date of Patent: Feb. 16, 2021

(54) SEABED BASE STRUCTURE AND METHOD FOR INSTALLATION OF SAME

(71) Applicant: Sembcorp Marine Integrated Yard Pte. Ltd., Singapore (SG)

(72) Inventors: Stig Rau Andersen, Bergen (NO); Harald Vartdal, Slemmestad (NO)

(73) Assignee: Sembcorp Marine Integrated Yard Pte. Ltd., Singapore (SG)

( * ) Notice: Subject to any disclaimer, the term of this patent is extended or adjusted under 35 U.S.C. 154(b) by 208 days.

(21) Appl. No.: 16/089,168

(22) PCT Filed: Mar. 31, 2017

(86) PCT No.: PCT/IB2017/051853

§ 371 (c)(1),
(2) Date: Sep. 27, 2018

(87) PCT Pub. No.: WO2017/068381

PCT Pub. Date: Oct. 5, 2017

(65) Prior Publication Data

US 2020/0298945 A1 Sep. 24, 2020

(30) Foreign Application Priority Data

Apr. 1, 2016 (NO) ..... 20160518

(51) Int. Cl.

| | |
|---|---|
| ***B63C 1/02*** | (2006.01) |
| ***E02B 3/06*** | (2006.01) |
| ***E02B 17/02*** | (2006.01) |
| ***E02D 23/02*** | (2006.01) |
| ***E02D 23/16*** | (2006.01) |
| ***E02D 27/20*** | (2006.01) |
| ***E02D 27/52*** | (2006.01) |

(Continued)

(52) U.S. Cl.

CPC ..... *B63C 1/02* (2013.01); *E02B 3/064* (2013.01); *E02B 3/068* (2013.01); *E02B 17/02* (2013.01);

(Continued)

(58) Field of Classification Search

CPC combination set(s) only.
See application file for complete search history.

(56) References Cited

U.S. PATENT DOCUMENTS 3,499,292 A 3/1970 Tavares
3,630,161 A * 12/1971 Georgii ..... E02D 27/06 114/256

(Continued)

FOREIGN PATENT DOCUMENTS

CN 103590415 A 2/2014
FR 2386648 A1 * 11/1978 ..... E02D 23/16

(Continued)

*Primary Examiner* — Kyle Armstrong
(74) *Attorney, Agent, or Firm* — Cesari & McKenna, LLP

(57) ABSTRACT

This publication relates to a shallow water terminal, preferably for storing and loading or unloading hydrocarbons, such as LNG, oil or gas. The base structure comprises a floatable, and removable seabed substructure (10) intended to be supported by a seabed (30), the seabed substructure (10) comprising a base structure (11) provided preferably with an upwards extending wall structure (22), arranged along at least a part of the periphery of the base structure (11), the base structure (10) preferably also being provided with an opening (23) in the wall structure (22) for allowing the floatable module to be berthed in and supported by the seabed substructure (10). The base structure (10) is provided with strong points (24) configured to receive the ends of preinstalled vertical piles (14) for at least temporary support of the base structure (11) during a piling operation for permanent piling of the base structure (10) to the sea bed (30). The publication also relates to a method for piling a base structure on or above a seabed (30).

13 Claims, 3 Drawing Sheets

(51) Int. Cl.
*F17C 13/08* (2006.01)
*E02B 17/00* (2006.01)

(52) U.S. Cl.
CPC ..... *E02D 23/02* (2013.01); *E02D 23/16* (2013.01); *E02D 27/20* (2013.01); *E02D 27/52* (2013.01); *F17C 13/082* (2013.01); *E02B 2017/0039* (2013.01); *E02B 2017/0069* (2013.01); *F17C 2221/033* (2013.01); *F17C 2223/0161* (2013.01); *F17C 2270/0121* (2013.01)

(56) References Cited

U.S. PATENT DOCUMENTS 3,958,426 A 5/1976 Heien
6,203,248 B1 * 3/2001 Childers ..... E02B 17/02 114/296
2005/0139595 A1 6/2005 Pepin-Lehalleur et al.
2009/0324341 A1 12/2009 Grinberg et al.

FOREIGN PATENT DOCUMENTS

| | | | |
|---|---|---|---|
| FR | 2894646 | A1 | 6/2007 |
| GB | 1369915 | A | 10/1974 |
| JP | 50000613 | B | 1/1975 |
| JP | S58127813 | A | 7/1983 |
| JP | 60126514 | U | 8/1985 |
| JP | H1096241 | A | 4/1998 |
| JP | 2002/121753 | A | 4/2002 |
| JP | 2005/145448 | A | 6/2005 |
| JP | 2012/512349 | A | 5/2012 |
| WO | WO-2006/041312 | A1 | 4/2006 |
| WO | WO-2013/002648 | A1 | 1/2013 |

* cited by examiner

SEABED BASE STRUCTURE AND METHOD FOR INSTALLATION OF SAME

CROSS-REFERENCE TO RELATED APPLICATIONS

This application is the National Stage of International Application No. PCT/IB2017/051853, filed Mar. 31, 2017, which claims the benefit of Norwegian Application No. 20160518, filed Apr. 1, 2016. The contents of both applications are hereby incorporated by reference in their entirety.

FIELD OF THE INVENTION

The present invention relates to a method for installing a base structure, configured to be supported by the seabed, preferably at least partly above a sloping seabed. The present invention relates also to a marine base structure, preferably for storing and loading or unloading hydrocarbons, such as LNG, oil or gas, comprising a floatable, and removable seabed substructure intended to be supported by a seabed, the seabed substructure comprising a base structure preferably being provided with an upwards extending wall structure, arranged along at least a part of the periphery of the base structure, the base structure also being provided with an opening in the wall structure for allowing the floatable module to be berthed in and supported by the seabed substructure.

BACKGROUND OF THE INVENTION

Harbour sites for LNG or large oil tankers are considered to be very hazardous. Therefore, it is not advantageous to place the sites in the near vicinity of populated areas. At the same time, the largest number of consumers of LNG is found in densely populated countries. A number of solutions have therefore been suggested to place LNG storage installations at sea.

It has previously been proposed to provide harbour sites for LNG loading at sea that either float or are placed, resting on the ocean bottom. The floating sites have the problem in common that the transfer of LNG between vessel and storage installation takes place between two floating, movable bodies, moving more or less independent of each other. The dynamics put great demands on equipment and safety if the loading takes place side by side.

A major problem of storage structures for liquids resting directly on the sea bed by gravity (GBS—Gravity Based Structure), especially in shallow waters, is that a GBS requires large volumes of fixed ballast to secure positive ground pressure at all times,—also in extreme conditions with e.g. storm surges. It is well known that storm surges mostly appear in shallow waters near land, e.g. in connection with tropical cyclones, where water levels near shore may temporarily increase by up to 8-9 meters. This will expose huge uplift forces onto a GBS with liquids storage with large water plane area at sea level and being located near shore. The additional fixed ballast volumes to counteract such temporary uplift forces will necessitate significant increase of the GBS volume and weight to secure positive bottom pressure at all times, but also to secure additional buoyancy during float-in, submergence and installation of the GBS onto the seabed. Such increase in volume will again result further increase of uplift forces, necessitating additional ballast volumes for both sea water ballast and fixed ballast,—representing a negative design effect spiral which will be make a GBS solution very costly.

It is also known that GBS solutions may not be feasible or in best cases will be very expensive for use in soft and unconsolidated seabed soils, such as found in river deltas. For such reasons the GBS may be equipped with suction skirts, but the mere size and vertical height of such skirt solutions may represent prohibitively expensive foundation solutions, having to date made floating storage bodies the only viable solution in areas with such soil conditions.

To reduce the problems associated with the dynamics of the floating bodies during loading operations, it has been proposed to install large, rectangular or square steel or concrete structures on the seabed, functioning as artificial harbours, where a continuous steel or concrete wall is intended to form a protection for incoming waves. Typical depths of water proposed are 8-30 metres. This type of large constructions are intended to be built away from populated areas and at the same time functioning as a breakwater for the LNG ships during loading and unloading operations.

The problem can be reduced by moving the ship over onto the leeward side of the harbour construction, but calculations and basin experiments have shown that the harbour construction which forms a continuous barrier must be built to be very large if one is to obtain a significant shielding effect when waves and swells come during one period from a particularly unfavourable angle. This is due to the well known effect that ocean waves will be bent around both sides of such a construction and a focal point will arise some distance behind the leeward side where the bent waves meet. At this focal point, the height of the waves can actually be higher than the incoming waves.

A large harbour construction placed on the ocean bottom, intended to act as a shield from the waves, will therefore be very costly. Different forms for such types of harbour sites for LNG built in concrete for shielding vessels from the waves during loading operations have been suggested. One suggested shape is, for example, to build the construction as a horseshoe and let the LNG vessels load/unload inside this. This will reduce the dynamics considerably, but the harbour site will be even more costly than a harbour site in the shape of a rectangle.

GB 1369915 describes a harbour site comprising a number of units that are afloat or sunk and otherwise constructed for placement on the seabed. Each unit comprises a base, load-carrying structure and moveable wave-breaking elements that can be moved if required.

U.S. Pat. No. 3,958,426 describe a harbour site comprising a number of units placed apart on the seabed, so that at least one straight mooring location is formed. The units are provided with fenders and wave dampening devices.

Applicants own publication WO 2006/041312 discloses a harbour plant for storage, loading and unloading hydrocarbons such as LNG at sea, the whole content of which hereby being included by the reference. The harbour comprises three units built from steel or concrete, placed on the seabed. The units are placed in sidewise relation in-line. The harbour is configured to dampen the waves, the vessel being intended to lie on the leeward side of the mooring.

Applicants own publication WO 2013/002648 discloses a harbour plant for storage, loading and unloading of hydrocarbon products at sea, comprising a number of units being mutually placed on the seabed so that a harbour plant is formed. The units are placed independently at a given distance apart in sideways direction and having a front surface along which a vessel is intended to be moored, forming passage(s) for parts of the waves, and being configured to dampen a part of the incoming waves while allowing other parts of the waves and current to pass through the harbour plant.

US 2005/139595 describes a plant storage and loading LNG, consisting of a seabed structure resting on a seabed, the seabed structure having a base slab resting on the seabed and three upwards extending walls. The seabed structure has an opening, allowing a floating module to be maneuvered into position inside the seabed structure and ballasted to rest on the base slab.

FR 2894646 describes a gravity based structure resting on the seabed due to its own weight and provided with downwards projecting and open skirts, pressed down into the seabed. The gravity based structure has a U-shaped form, with vertical walls extending upwards from a submerged bottom slab, provided with buoyancy chamber, functioning as weight for providing the required weight. One embodiment of the gravity based structure may also be provided with piles extending downwards through the vertical walls and into the supporting soil, the piles being terminated at the top of the walls above sea level.

JP H1096241 relates to structures such as bridge foundation, where the bridge foundation is in the form of a piled jacket structure with a centrally arranged cylindrical tank. Piles are used for fixing the jacket structure to the sea bed. In addition preinstalled piles are piled into the ground serving as initial, but still permanently installed supports for the piled structure. Said initially installed piles are terminated at the sea bottom.

CN 103590415 relates to a prefabricated caisson provided with a bottom slab and upright walls extending vertically upwards form the bottom slab, the vertical wall forming box chambers. The bottom slab is provided with movable steel bottom plates and the caisson is supported by large-diameter tubular columns. During the initial stage of the installation process, the bottom surface of the slab is caisson is supported below the sea level by a number of temporarily installed piles.

However, these harbour plants for storage can be large in scale, complex and expensive. They take a long time to build and they have limited variation with respect to mobility and other applications. Due to dependencies of deep skirts to enable foundation, problems may also be experienced during installation, in particular in shallow waters with muddy or soft seabed. In addition, the density, composition, consolidation and topography of seabed soil may vary significantly for one seabed location to another. For example, the soil in river mouths will often be dominated by soft, muddy soil with a kind of yoghurt texture, while other seabed areas may be influenced or overlapped by hard sandstone, limestone or ancient volcanic rock. This will have direct impact on the load bearing capacity of the seabed soil, and hence the possibility to find a predictable and reliable foundation solution for a seabed structure which shall be resting onto the seabed.

Hence, there exists a requirement for cost-effective, versatile and flexible harbour plant systems that can be installed in shallow waters and that is suitable for installation in areas with a sea bed having pour load carrying capacity. Moreover, there is a demand of a offshore plant which can be standardized as far as possible for fabrications and cost reasons, and which can easily be deployed in offshore or near shore locations with any type of seabed soil.

There is also a need for a method for secure proper and adequate piling of such harbour plant, avoiding relative movement between the plant and the sea bed during the piling operations.

SUMMARY OF THE INVENTION

The principle used according to be present invention is to use a piled base structure where a major part of the weight of the base structure and possibly also a floatable module to be berthed in and supported by the base structure are carried by piles, extending to a sufficient depth into the seabed soil in order to be carry and withstand all downward, upward or sideward loads, weights and forces acting on the base structure. In this respect the base structure may either rest on the seabed with at least a part of its foot print or the base structure may be positioned at a distance above the seabed soil, i.e. without really being in contact with the seabed soil, all loads, weights and forces being taken by the piles.

Moreover, the system and the method according to the present invention is based on the principle that a temporary arrangement of piles is used for supporting the base structure during the installation phase, said temporary pile arrangement taking all loads, weights and forces during the piling operation until a permanent pile arrangement is established and the base structure is permanently supported by the permanent piles piled into seabed, so that the piled structure is able to withstand all load criteria, such as a 100-year storm or surge.

It should be appreciated that the installed temporary piles may, or may not, be removed or cut off upon completed installation of the substructure. If the temporarily supporting piles are to be removed, the piles should preferably be cut off at a depth where the cut off piles do not constitute a hazard to the operation of the base structure and the floatable module and/or vessels to be berthed in and supported by the seabed substructure.

An object of the present invention is to provide a solution increasing the weather window for installing such base structure and also to make installation more independent of the weather and sea conditions.

Another object of the present invention is to enable a more expedient installation process by enabling simultaneous piling operation of more than one pile at the time.

An object of the present invention is to provide an installation method for a base structure intended to be supported by the seabed by means of a number of piles, wherein during the installation of the supporting piles and until proper fixing of the permanent piles to the harbor plant is achieved, the permanent piles are not affected by forces, loads or weights caused by or acting on the base, even though such piling operation is performed on and from the base structure.

Another object of the present invention is to provide s seabed terminal designed in such way that the terminal that does not require use of downwards protruding open skirts in order to secure stable founding on a seabed site, let alone a need for a bottom surface of the seabed substructure to partly or completely be in contact with the seabed. In fact the seabed structure may be supported completely by and resting on the piles used.

Another object of the present invention is to provide a multipurpose shallow water seabed terminal with storage units and a method for establishing such seabed terminal.

Yet another object of the invention is to provide a seabed terminal that is designed for transferring very large vertical loads onto the seabed soil, caused by large weights of liquids stored inside the storage module without allowing any relative motions between the terminal and the supporting structure and any relative motions between the seabed and the terminal.

A further object of the present invention is to provide a shallow water seabed terminal which is flexible, cost effective and easy to establish in most types of seabed soil conditions.

Another object of the invention is to provide a near shore storage system which may, when required, also be located in extremely soft and muddy soil as found in river deltas and seabed areas of unconsolidated soil where gravity based structures cannot be installed or will be prohibitively expensive.

An additional object of the invention is that it may be given the structural capacity to resist large buoyancy uplift forces during extreme storm surges without any major volumetric modifications of its loading bearing structure Yet another object of the invention is to enable building of each of the units of the seabed terminal at reasonable price and efficiently and as complete as possible at a traditional construction site, preferably at a dockyard with the use of a dry dock. Thereby, the costly finishing work at sea will be minimised. After final outfitting at the building site, each of the units is brought or towed to the installation location, finally to be lowered down with the use of known techniques.

It is also an object of the invention to ensure safe transfer of large vertical loads into the seabed, generated by storing large volumes of liquids above sea level.

It is also an object of the present invention to provide a seabed terminal comprising a seabed substructure and a storage module specially designed to adapt each to other, and to simplify the berthing of the storage module in a time and cost effective way.

It is also an object of the invention to provide a quick and safe installation of the storage module with topside equipment.

The objects of the present invention are achieved by a shallow seabed terminal and a method for establishing such seabed terminal as further defined by the independent claims. Embodiments, alternatives and variants of the invention are defined by the dependent claims.

The wall structure may form an integrated part of the base structure, forming a seabed substructure unit and may be provided with means for ballasting. At least parts of the wall structure extend above the water surface.

According to the present invention a shallow water base structure for example for storing and loading or unloading hydrocarbons, such as LNG, oil or gas is provided, comprising a floatable, and removable seabed substructure intended to be supported by a seabed), the seabed substructure preferably comprising a base structure provided with an upwards extending wall structure, arranged along at least a part of the periphery of the base structure, the base structure preferably also being provided with an opening in the wall structure for allowing the floatable module to be berthed in and supported by the seabed substructure. The base structure is provided with strong points configured to receive the ends of preinstalled vertical piles for at least temporary support of the base structure during a piling operation for permanent piling of the base structure to the sea bed.

According to one embodiment the strong points extend laterally outwards from the base structure and are preferably positioned above sea level.

The strong points may be arranged on the lower side of beams, cantilevers or sleeves or ducts extending laterally out from the wall(s), preferably above the sea level.

Moreover, the strongpoints may be provided with releasable locking devices for temporarily locking the upper part of a preinstalled pile in fixed position.

According to an embodiment the wall structure may form an integrated part of the base structure and that the strong point forms an integrated part of the base structure or the wall structure.

The strong points may alternatively be positioned below the sea level either on the side walls or on the bottom surface of the base structure. In such latter case the piles may form a permanent part of the piling system.

According to the present invention also a method for installing the base structure is provided, the base structure being configured to be supported by the seabed in a piled manner using a number of piles driven into the seabed. For the purpose of installing the base structure, at least two rows of piles, each row comprising at least two piles, are driven into the seabed, the distance between the two rows and the distance between adjacent piles in a row each being configured to correspond with purpose built strong points on the base structure, whereupon the base structure is towed in between the two rows of piles and brought to a position where the strong point are vertically aligned with a corresponding upper pile end, whereupon the base structure is ballasted so the base structure will rest stably on the various piles, whereupon the base structure is piled to the seabed.

The base structure is piled to the sea bed using a number of permanent piles driven into the seabed, the top of the piles being rigidly fixed to the base structure. Moreover, the piles supporting the base structure stably and rigidly during the pile operation may be removed upon completed process of permanent piling of the base structure. According to one embodiment, the provisional or temporary piles may be cut off at the seabed level.

An essential feature of the present invention is that the base structure is provided at least with a beam or slab extending laterally outwards from the upper part of vertical wall structure above the sea level, at least along two opposite side, possibly also along third side ides of the base structure, configured to support the base structure in sufficient stable position until the base structure is piled to the seabed by means of a permanent arrangement of permanent piles.

According to the invention, at least one removable seabed substructure is provided stably supported by piles extending into the seabed, so that a stable harbour foundation is formed. The seabed substructure comprises a base structure provided with buoyancy devices and an upward extending wall structure also provided with buoyancy devices. The wall structure is arranged along at least a part of the periphery of the base structure and comprises at least one opening in the wall structure for introducing a floatable storage module. The floatable module is removable arranged on top of the base structure within the wall structure, together forming an offshore unit supported by the seabed at least by means of piling.

According to a preferred embodiment of the invention, the wall structure of the base forms an integrated part of the base structure forming a seawater substructure unit. Moreover, the cantilever, beam or slab arranged at the top of the side walls form an integral part of the wall structure and is designed and dimensioned to withstand all temporary loads forces and moments occurring during the piling process. For this purpose the cantilever, beam or slab may be provided with strong points to co-function with temporarily purpose installed piles.

It should be appreciated that the base structure may be provided with ballast tanks, using water to adjust weight and buoyancy and the vertical forces and load exposures acting on the temporary piles during installation of the base structure.

The wall structure of the seabed substructure is above sea level (but the wall structure can also be below the sea level). Some of the advantages of having part of the seabed substructure above water, as shown in the drawings, are:

a) The water plane facilitates and reduces uncertainty around stability during installation of the seabed substructure.
b) The part of seabed structure will facilitate and simplify the float-in and installation of the storage module.
c) Piling machinery may be placed on the seabed substructure above water level, which reduces cost and time.
d) The seabed substructure above water level will represent an added protection against ship collision.
e) Some equipment, e.g. cargo loading arms may in some cases be installed onto the seabed substructure and hence a bit away from the storage module.
f) A great advantage of the invention is that the piles of the substructure can also be designed for tensions to absorb uplift buoyancy forces. This feature will facilitate installation in extremely soft soils, such as river deltas, where the soil has limited vertical, downward holding capacity.

Moreover, due to the bottom slab configuration used covering more or less the entire footprint of the base structure a large degree of freedom is achieved with respect to total available number of piles feasibly to be used and the distances between neighbouring piles and positions of such number of piles. This may in particular be of importance in areas having poor or soft soil conditions and/or where extreme environmental loads and impacts may occur, such as large waves and storm surges.

By providing a quay side with outwards projecting beam or slab it is possible to berth a vessel at a distance from the vertical wall, enhancing maneuvering and mooring the vessel along the quay side.

In addition this feature of the piled foundation is also very useful when the storage system according to the invention is installed in shallow cyclone and storm surge exposed areas, where water levels in extreme 100 years cases may rise as much as 8-9 meter above normal sea level. For such cases the foundation piles may be designed to take a large portion of the uplift buoyancy forces, while other parts of these extreme, temporary uplift forces may be counteracted by active water ballasting of the storage module. In order to have an efficient transfer of large vertical structural forces, it is also an advantage that the main structural beams of the base structure and the storage module has mirrored structural interfaces. This means that vertical forces from the bulkheads storage module are preferably transferred directly into the main structural beams of the base structure.

Another important advantage of using the piles according to the present invention is that the piles may take both tension and compression, and at the same time in an efficient and cost effective manner allow for pile length of varying lengths as dimensions. The number, positions and dimensions of the ducts or sleeves may be configured in such way that extra, unused ducts or sleeves are provided in case further piling is required at a later stage.

The seabed unit of the seabed terminal may be designed to take very large vertical loads onto the seabed from large weights of liquids stored inside the storage module without any motions of the seabed terminal, typically up to, but not limited to 150,000 tonnes deadweight, corresponding to the capacity of a large tanker ship. Some of this capacity may be obtained by increasing the height of the storage volume while maintaining the horizontal footprint of the seabed terminal.

Another advantage is that the seabed substructure according to the present invention does not necessarily have to rest on the seabed, the weight, forces and loads being carried by the piles. Moreover, the seabed substructure is not dependent on use of skirts in order to resist tension, i.e. uplift of the structure caused for example by storm surge. Hence, the underside of the base structure does not need to have any load bearing contact with the seabed soil and the variable, operational and environmental loads of the sea terminal is taken up by the piles.

Sufficient bearing and supporting capacity may be obtained, depending on the load bearing capacity, achieved by means of the shear force between the pile surfaces and the corresponding wall surface of the grouted ducts or sleeves. Because of the grout in the annulus formed between the outer pile surface and the surface of the ducts or sleeves, required shear resistance is obtained to resist produced shear forces acting in this joint.

By being in position the base structure above the sea bed the environmental effect of the base structure on the marine seabed life is eliminated or substantially reduces.

SHORT DESCRIPTION OF THE DRAWINGS

One embodiment of the method according to the invention shall be discloses in more detail in the following description below with reference to the enclosed figures, wherein.

DETAILED DESCRIPTION OF EMBODIMENTS OF THE INVENTION

Figure 1:
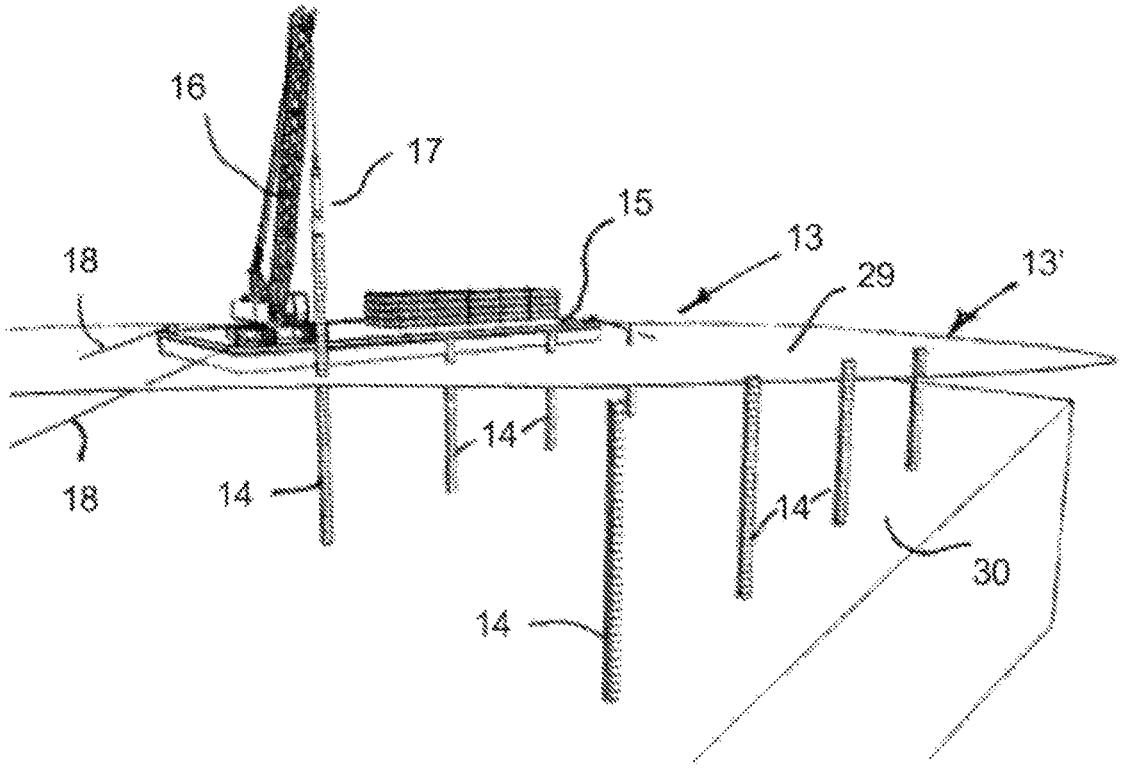
FIG. 1 shows schematically a first stage of the installation procedure, where two rows of aligned piles in spaced relation are established.

The following description of the exemplary embodiment refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a method for installation of a base structure on a seabed in general and preferably, but not necessarily on a sloped seabed and/or on a seabed with a low bearing capacity.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

The key area for the invention is to provide a quick and safe installation of the storage module with topside equipment where the base structure is stably and rigidly supported during the piling operation of the permanent piles. This is the costly part (90-95%) of the entire installation. By having a pre-installed base foundation, which is stabilized at least by means of piles and leveled in advance to the seabed, then the installation of the storage module can take place within a few hours.

In addition, the present invention offers the possibility of establishing a seabed terminal on different soil conditions. The density, composition, consolidation and topography of seabed soil may vary significantly for one seabed location to another. This will have direct impact on the load bearing capacity of the seabed soil, and hence the possibility to find a predictable and reliable foundation solution for a seabed structure which shall be supported by the seabed. According to one embodiment, the based foundation may be in the form of a semi-submersible floating body, piled to the seabed. In this case the base substructure can be ballasted as a semi submersible structure and piled to the seabed through the base structure and possibly, but not necessary, the wall structure of the seabed substructure. It is important in these cases to have an efficient transfer of vertical structural forces, it is an advantage that the main structural beams of the base structure and the storage module has mirrored structural interfaces. This means that vertical forces from the bulkheads storage module are preferably transferred directly into the main structural beams of the base structure and into the piling structure and to the seabed. Tests has shown that the piled seabed substructure must tolerate and stand a weight of 100 000-120 000 tons.

In the Figures, a base structure having upwards extending walls along three sides of the base structure is shown, allowing float in of a floated at one end of the base structure, the upwards extending walls on the remaining sides protecting the floater on the remaining sides while berthed within the U-shaped base structure. It should be appreciated, however, that the base structure may be provided with two opposite open ends, the floater being for example in the form of two more or less parallel vertical wall sections provided with buoyancy, interconnected by a base slab or for example two or more laterally extending box beams interconnecting the two vertical wall sections at their lower end. Such configuration will allow float-in of the floater at either end of the base structure.

FIG. 1 shows schematically a first stage of the installation procedure, where two rows 13,13' of aligned piles 14 are arranged, the last pile in the row 13 being in process of being forced into the seabed 30 by means of a piling barge 15 with a crane 16 and a pile driving device 17 suspended from the crane 16. During this stage the barge 15 may be moored by means of conventional seabed 30 anchors (not shown) and mooring lines 18 (two of which being shown).

Figure 2:
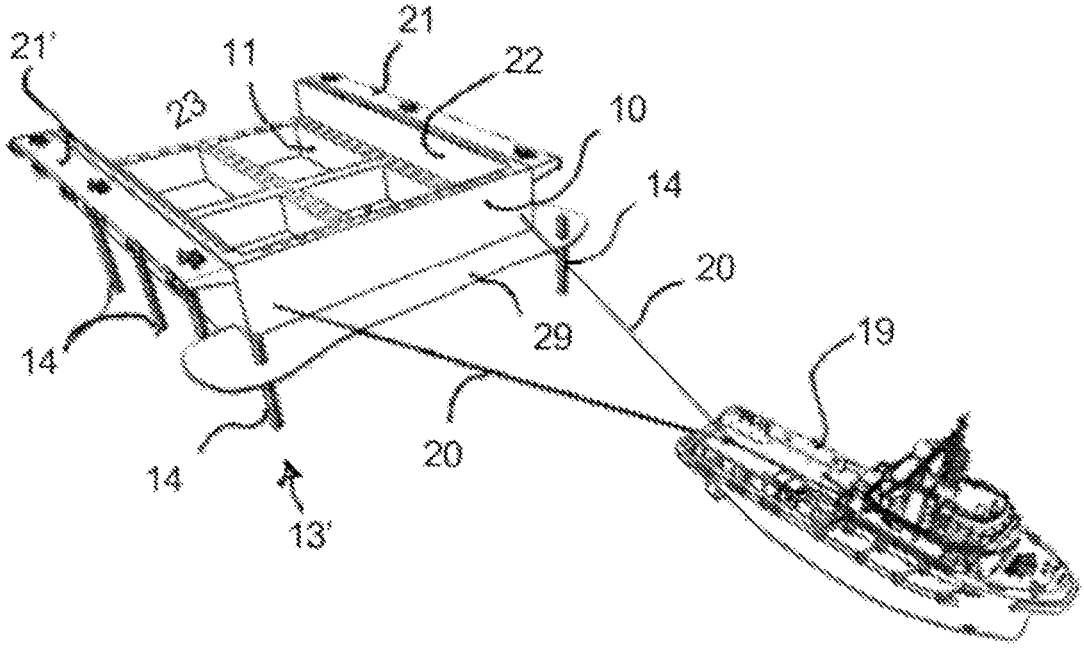
FIG. 2 shows schematically a base structure to be supported by the piles is towed into position between the two spaced apart aligned rows of piles by a towing vessel.

FIG. 2 shows schematically a base structure 10 being towed into position between the two rows 13,13' of aligned piles to be supported by the piles is towed into position between the two spaced apart aligned rows of piles by a towing vessel 19 and a pair of towing lines 20. The base structure 10 is provided with an outwards projecting cantilever 21,21' extending outwards from the top of the base structure along two parallel top sides, each cantilever 21,21' being configured to rest on top of a corresponding row 13,13' of piles 14. For such purpose the cantilevers 21,21' are provided with strong points 24 (not shown in FIG. 2) dimensioned and configured to carry the weight of the base structure 10 and possible temporarily appearing loads, forces and bending moments introduce at least during the installation stage of the base structure 10 until the base structure is safely piled to the seabed.

The seabed base structure 10 comprises a inwards projecting cantilever and/or beam structure 11 and upwards extending wall structures 22 arranged along at least a part of the periphery of the base structure 10. The wall structure 22 forms an integrated part of the cantilever and/or beam structure 11, together forming a seabed base structure 10. Both the cantilever and/or beam structure 11 and wall structure 22 are provided with buoyancy devices (not shown). Such buoyancy means may be in the form of tanks and compartments in the cantilever and/or beam structure 11 and in the upwards extending wall structure 22. The embodiment of the seabed substructure 10 shown in FIG. 1 is provided with a bottom beam structure in longitudinal and transverse direction, forming upwards open compartments in the base structure 10 between the cantilevers 11/beams. The compartments may be closed at the lower end by a bottom slab or the compartments may optionally be open downwards, providing access to the permanent piles (not shown) in case the base structure 10 is in an elevated position more or less above the seabed 30. Said longitudinal and transverse beams or walls may serve as a supporting, strengthen surface for supporting a floatable storage module to be floated in between the upwards extending wall structure 22, over the base structure 10 and ballasted to rest on said surface. The upwards extending wall 22 extends along three sides of the base structure 10 and is provided with an opening 23 in the wall structure for introducing a floatable storage module (not shown in FIG. 2) in over the base structure 10. The storage module may be removable arranged on top of the base structure 10/internal cantilever 11 and possibly the beams within the wall structure, together forming a seabed unit.

The seabed base structure 10 is provided with floating buoyancy and has means for ballasting (not shown) and is intended to be placed on or just above the seabed 30, supported by a number of permanent (not shown in FIG. 2) or optionally, also resting on the seabed partly due to gravity, fixed by means of said permanent piles. The upward extending wall structure 22 of the substructure 10 has perforations or ducts/sleeves through the wall structure for optional and/or additional piling, and also there are perforations in the base structure 11 for receipt of the permanent piles, intended to be driven into the seabed soil. The ducts and accessories for receiving the piles are described in the PCT/NO2015/050156, which hereby is incorporated by the reference and will thus not be described in further detail. A vessel 16 with machines and tools for piling are moored next to the wall structure 2, similar to the one disclosed in FIG. 1 may be used for the piling operations. As indicated in Figure, permanent piles may be arranged both in longitudinal and transverse direction along the foot of the three walls 22 along the submerged front beam beneath the opening of the cantilever and/or beam structure 11, and along the internal cantilever 11 and/or walls or beams forming the upwards open compartments there between. In such way the entire footprint or at least parts of the footprint may be provided with permanent piles for supporting the base structure 10 properly and safely. The number of piles used and their position, diameter and length depend on the weight to be supported and on the seabed soil condition.

An advantage according to the present invention is that the seabed base structure 10, constituting a part of the seabed unit for floating modules, such as a floatable LNG storage unit or barge according to the invention, can be lowered down to installed offshore or near shore, be removed, be moved and be replaced to form new individual configurations as required using known techniques.

Figure 3:
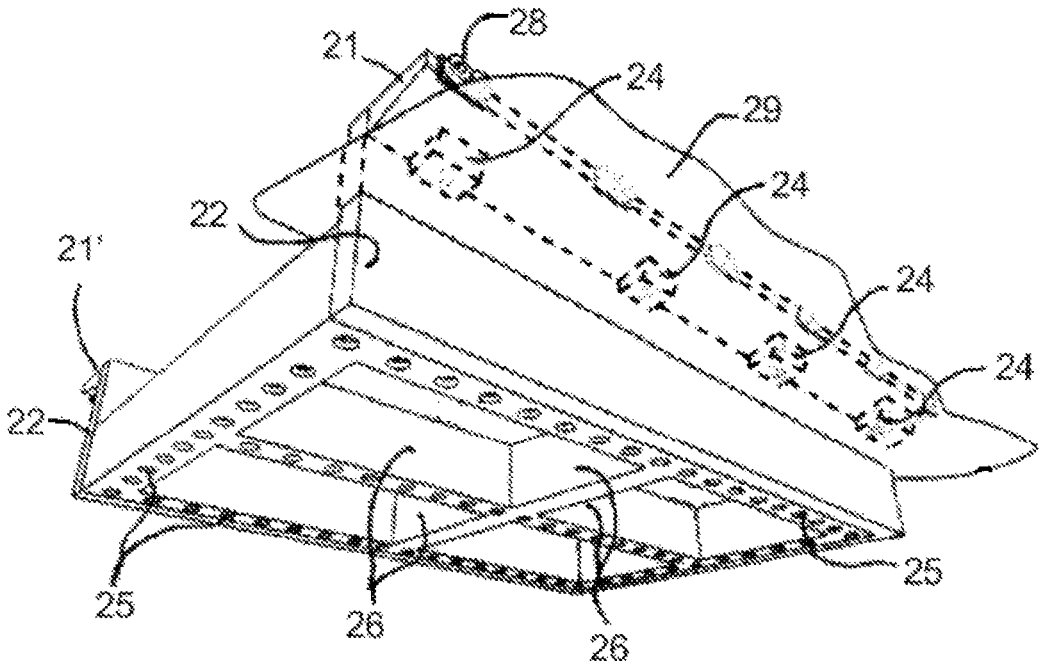
FIG. 3 shows schematically in perspective seen from below an embodiment of a base structure according to the present invention.

FIG. 3 shows schematically in perspective seen from below an embodiment of a base structure 10 according to the present invention. As shown the lower side of the cantilevers 21,21' are provided with strong points 24 configured, designed and dimensioned to receive the upper ends of the temporary piles 14, supporting the base structure at least until a sufficient number of permanent piles are piled through the ducts 25 in the inwards projecting cantilever and/or beams 11 and fixed to said parts. As shown in FIG. 3, the upwards projecting walls 22 are interconnected by beams 26 forming upwards open cells 27 without a top or a bottom slab, configured together with the cantilevers 11 to support a floating unit, configured to be de-ballasted and to rest on said parts of the base structure 10.

Along the outer edge of the upper, outwards projecting cantilever devices 28 serving as fenders may be arranged, fendering between the cantilever and the side of a vessel to be moored along the side of the base structure.

Figure 4:
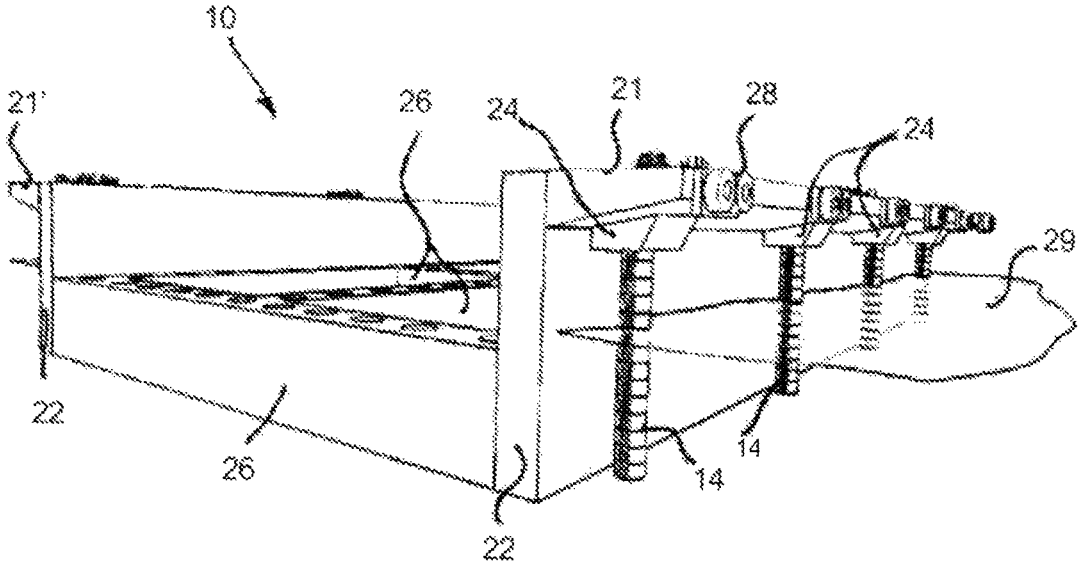
FIG. 4 shows schematically in perspective an embodiment of the base structure positioned and supported by the piles in aligned position on at least both sides of the base structure.
Figure 6:
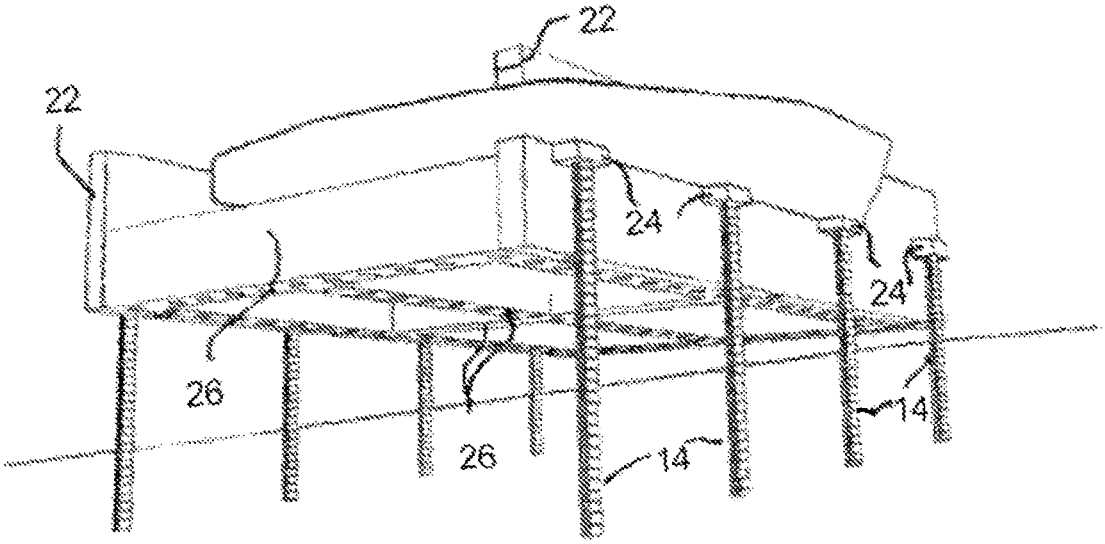
FIG. 6 shows schematically an alternative position of the strong points.

FIG. 4 shows schematically in perspective an embodiment of the base structure 10 positioned and supported by the temporary piles 14 in aligned position along at least both sides of the base structure 10. The permanent piles may now be installed by forcing the piles through the ducts 25 down into the seabed 30 to sufficient depth for stably supporting the base structure temporarily. The base structure 10 may be permanently fixed to the seabed 30 by said permanent piles, while the base structure 10 is stably fixed in position and supported by means of the rows the temporary piles 14. As indicated in FIG. 6, showing schematically an alternative position of the strong points 24, the strongpoint is made as an integrated part of the vertical walls 22, projecting laterally outwards from the wall 22 and may be positioned either above or below the sea level 29.

Figure 5:
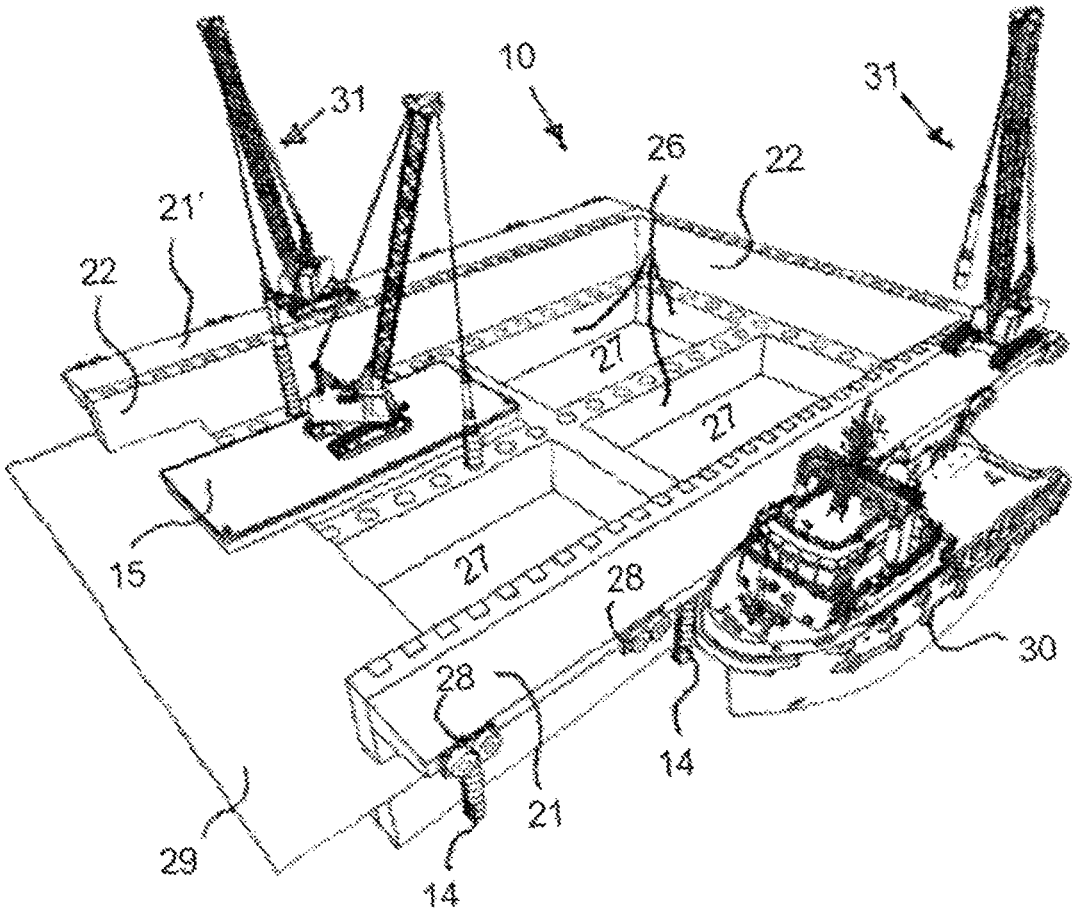
FIG. 5 shows schematically and in perspective the base structure in position with a supply vessel moored along one side of the installed base structure.

FIG. 5 shows schematically and in perspective the base structure 10 in position with a supply vessel 30 moored along one side of the installed base structure 10. The Figure shows a stage where the base structure is resting firmly on the temporary piles 14*o* its own weight and possibly any additional weight due to any ballast water, the weight being sufficiently larger than the buoyancy of the base structure. At such stage the process of establishing the permanent piling system as further disclosed in PCT/NO2015/050156 may start, said publication being included by the reference with respect to the build-up of the permanent piling arrangement and the method for establishing a proper piling of the base structure.

As shown in FIG. 5 piling operations of the permanent piles may be performed more or less simultaneously by means of a piling barge 15, similar to the one disclosed in FIG. 1 and by movable cranes 31 with associated piling devices 17, for example similar to the one disclosed in FIG. 1.

Upon completed piling operation of the two parallel rows 13,13' of the temporary piles 14, a base structure 10 is towed into position between the two rows 13.13' by means of a towing vessel 19 until the strong points 24 along the lower surface of the outwards projecting cantilevers 21,21' are in aligned position above the corresponding temporary piles 14, whereupon the base structure 10 is ballasted so that the base structure 10 is lowered down onto a respective pile 14 and exerting a downwards acting force or weight on to the piles 14, the piles taking more or less the total vertical weight of the base structure 10. Each strong point may have a recess sufficiently deep to allow an upper part of the pile ends to be inserted into said recess. The strong points may also be provided with a releasable locking mechanism for temporarily locking the joint between the upper end of the pile 14 and the strong point 24.

Once the base structure is sufficiently secured and fixed in a proper position, the permanent piling operation for example all in accordance with the method, system and arrangement described in PCT/NO2015/050156 may be initiated. Upon completed permanent piling operation, the temporary piles may be cut off, for example at seabed level or at a depth where the pile ends do not represent any hazard to the operation of the piled base structure 10.

The base structure 10 is provided with a system (not shown) for ballasting and is preferably made from steel, although also other materials can also be used such as concrete. It should be appreciated that the storage module 10 according to the present invention also may be provided with means, such as loading systems, cranes, winches etc. on top of the storage module. When the storage module arrives at the site, it is mated with the seabed substructure or base structure 10. During this mating operation, the floating module is manoeuvred in through the opening at one end of the base structure and in between the two parallel upwards extending side wall structures 22. The floating storage module is guided on top of the base structure 10, within the wall structure 22. The floating module is the ballasted so that it rests stably on the base of the seabed substructure 10, forming a seabed assembled unit.

The permanent pipe arrangement for ballasting and for rigidly fixing the piles to the base structure 10 may be of a type as described in PCT/NO2015/050156, the part of said application relating to the pile system hereby being incorporated by the reference. Once a permanent pile is driven into its intended depth in the seabed soil, a annulus between the external surface of the pile and the surface of the duct wall may be grouted by injecting grout from a grout producing plant (not shown) through a grout supply line. Said grout supply line may have its outlet at the lower end of the duct. As a consequence of such outlet position, injected grout from the supply line will be pressed upwards through the annulus until the injected grout exits at the top of the duct. In order to prevent the grout from being forced downwards and oy of the annulus and into the interface between the lower surface of the bottom plate of the base structure and the seabed 30, a ring formed stopping seal is arranged, having contact surface against the outer surface of the pile around its entire circumference. The stopping seal may be in the form of a circular hose with cylindrical cross section, or as a semi-circular body, both free ends of the semi-circular body being sealing fixed to the surface of the duct, extending around the entire circumference of the duct, providing a fluid tight seal. The interior void of the seal is fluid contact with a pressurized source (not shown) through a fluid supply line, securing supply of a pressurized fluid to the interior of the seal at the start-up of the grouting process, causing the stopping seal to expand, and possibly relieving the fluid pressure upon completed grouting process.

According to one embodiment of the invention, sixty one permanent piles having a diameter of 2.2 m and e length of 50 m are required in order to sustain the maximum environmental design loads. These piles are inclined with a 5° angle from the vertical in order to reduce the ground effect. In this context, it should be appreciated that where piles supporting the base structure are positioned close to each other a simple and conservative approach mat be to reduce the oiling capacity to approximately ⅔ of a single pile capacity, when considering load cases.

It should be appreciated that the piles may extend vertically down into the seabed 30 or, they may be arranged inclined with respect to the vertical, either in same direction, inwards or outwards, or a combination of the same.

The seabed substructure may also be provided with a harbour section, configured for allowing vessels to moor alongside the harbour section. The construction material may be concrete or steel or a combination of both. The harbour section is fixed to and built into at least one of the vertically extending walls, so that all forces and loads is taken by the seabed substructure and transferred to the piles. Moreover, the harbour section may preferably be arranged on the opposite side(s) of the prevailing direction of wind and/or waves, providing a shelter for the vessel(s) moored along the harbour section.

The invention claimed is:

1. A floatable and removable seabed base structure (10) for storing and loading or unloading hydrocarbons and intended to be supported by a seabed (30), the seabed base structure (10) comprising a beam structure (11) provided with an upwards extending wall structure (22) arranged along at least a part of the periphery of the seabed base structure (10), the seabed base structure (10) having an opening (23) in the upwards extending wall structure (22) for allowing a floatable module to be berthed in and supported by the seabed base structure (10), the seabed base structure (10) having a plurality of strong points (24) each configured to receive the end of a preinstalled vertical pile (14) for at least temporary support of the seabed base structure (10) during a piling operation for permanent piling of the seabed base structure (10) to the sea bed (30), the plurality of strong points (24) extending laterally outwards from the upwards extending wall structure (22), wherein the plurality of strong points (24) are arranged spaced apart from one another longitudinally across a length of the upwards extending wall structure (22) and away from adjacent corners of the upwards extending wall structure (22).

2. The seabed base structure (10) according to claim 1, wherein the plurality of strong points (24) are positioned above sea level (29).

3. The seabed base structure (10) according to claim 1, wherein the plurality of strong points (24) are positioned below sea level (29).

4. The seabed base structure (10) according to claim 1, wherein the plurality of strong points (24) are arranged on a lower side of beams, cantilevers or sleeves or ducts extending laterally out from the upwards extending wall structure (22).

5. The seabed base structure (10) according to claim 1, wherein the plurality of strong points (24) are each provided with a releasable locking device for temporarily locking an upper part of the preinstalled vertical pile (14) in a fixed position.

6. The seabed base structure (10) according to claim 1, wherein the upwards extending wall structure (22) is an integrated part of the seabed base structure (10) and the plurality of strong points (24) form an integrated part of the upwards extending wall structure (22).

7. The floatable and removable seabed base structure (10) according to claim 1, wherein each strong point (24) comprises a recess dimensioned to encircle along a circumference of the end of the received preinstalled vertical pile (14).

8. The floatable and removable seabed base structure (10) according to claim 1, wherein the plurality of strong points (24) are each arranged on an underside of a cantilever extending laterally outwards from the upwards extending wall structure (22).

9. A method for installing a seabed base structure (10) according to claim 1 on a seabed (30), the method comprising driving at least two rows (13,13') of temporary piles (14) into the seabed (30), the distance between each of the at least two rows (13,13') and the distance between adjacent temporary piles (14) in each row (13,13') corresponding with a location of purpose built strong points (24) on the seabed base structure (10), towing the seabed base structure (10) between the at least two rows (13,13') of temporary piles (14) and bringing it to a position in which each of the purpose built strong points (24) are vertically aligned with a corresponding temporary pile (14) upper end, ballasting the seabed base structure (10) to rest stably on the temporary piles (14), and piling the seabed base structure (10) permanently to the seabed (30).

10. The method according to claim 9, wherein the seabed base structure (10) is piled to the sea bed (30) using a number of permanent piles driven into the seabed (30), a top of each permanent pile being rigidly fixed to the seabed base structure (10).

11. The method according to claim 9, further comprising removing the temporary piles (14) supporting the seabed base structure (10) stably and rigidly during the pile operation upon completion of permanent piling of the seabed base structure (10).

12. The method according to claim 11, wherein the temporary piles (14) are removed by cutting off the temporary piles (14) at a level of the seabed (30).

13. The method according to claim 9, wherein the seabed base structure (10) is provided with ballast tanks, using water to adjust weight and buoyancy and the vertical forces and load exposures acting on the temporary piles (14) during installation of the seabed base structure (10).

* * * * *